US006349505B1

(12) United States Patent
Figge et al.

(10) Patent No.: US 6,349,505 B1
(45) Date of Patent: Feb. 26, 2002

(54) WINDOW PROTECTION APPARATUS

(75) Inventors: Ward Figge, Dale City, VA (US); John Crawford, Topanga, CA (US)

(73) Assignee: Atlantic Research Corporation, Gainesville, VA (US)

( * ) Notice: Subject to any disclaimer, the term of this patent is extended or adjusted under 35 U.S.C. 154(b) by 0 days.

(21) Appl. No.: 09/431,141

(22) Filed: Nov. 1, 1999

(51) Int. Cl.[7] ..... E06B 5/12; E06B 7/08
(52) U.S. Cl. ..... 52/1; 49/64; 49/74.1
(58) Field of Search ..... 52/1, 508; 160/1, 160/6, 5; 49/74.1, 92.1, 64

(56) References Cited

U.S. PATENT DOCUMENTS

| | | | | | |
|---|---|---|---|---|---|
| 499,647 | A | | 6/1893 | Tufts | |
| 790,632 | A | * | 5/1905 | Hall | 160/5 |
| 803,618 | A | | 11/1905 | Mumford | |
| 1,355,246 | A | | 10/1920 | Myvalt et al. | |
| 1,791,151 | A | * | 2/1931 | Tarvid | 160/5 |
| 2,489,879 | A | * | 11/1949 | Grebe | 160/6 |
| 3,249,148 | A | * | 5/1966 | Zablodil | 160/3 |
| 3,485,284 | A | * | 12/1969 | Turner | 160/1 |
| 3,521,546 | A | * | 7/1970 | Day | 52/1 |
| 3,571,973 | A | * | 3/1971 | Roberts | 160/6 |
| 3,662,670 | A | * | 5/1972 | McCoy | 98/119 |
| 3,687,185 | A | * | 8/1972 | Singer | 160/1 |
| 3,756,137 | A | * | 9/1973 | Scharres | 160/1 |
| 3,796,248 | A | * | 3/1974 | McCabe | 160/1 |
| 3,872,911 | A | * | 3/1975 | Janes | 160/1 |
| 4,424,850 | A | * | 1/1984 | Klein | 160/1 |
| 4,644,990 | A | * | 2/1987 | Webb | 160/5 |
| 5,217,407 | A | * | 6/1993 | Bailey | 160/1 |
| 5,275,219 | A | * | 1/1994 | Giacomel | 160/6 |

* cited by examiner

*Primary Examiner*—Michael Safavi
(74) *Attorney, Agent, or Firm*—Nixon & Vanderhye P.C.; Frank P. Presta

(57) ABSTRACT

Apparatus for protecting an occupant of a building from flying debris from a frangible structure such as a window or the like, in the event of an explosion or other blast. The apparatus comprises a protective louver system disposed adjacent the building structure. The louver system comprises a plurality of louvers that are movable from an open position to a closed position wherein they form a protective barrier covering the building structure. A louver closing device is operatively connected to the louvers and is operable to move them to the closed position in the event of an explosion or other blast. The louvers are provided with locking portions so that they are interlocked when in the closed position and displaced inwardly by an explosion or other blast. Reinforcing cables may be positioned adjacent the inner surface of the louver system to support the louvers in the closed position when they are displaced inwardly by the explosion or other blast.

9 Claims, 6 Drawing Sheets

WIDTH a LARGER THAN WIDTH b
TO EFFECT / MAINTAIN POSITIVE CLOSING
DUE TO PRESSURE LOADS

WINDOW PROTECTION APPARATUS

BACKGROUND OF THE INVENTION

The present invention relates generally to an apparatus for protecting building occupants from injury caused by flying debris from a window as a result of an explosion or the like. More particularly, it relates to such an apparatus wherein a gas generator or similar device is used to close a louver system to form a protective barrier adjacent the window before an explosion causes it to disintegrate.

Terrorist bomb attacks provide a demonstrable need for increased protection for building occupants from the debris hazards generated by the blast. Loss of life in such attacks is caused mainly by the debris hazard generated by the blast., e.g., debris from the breakup of windows, cladding and ceiling and room fixtures. While debris hazards can be mitigated by the use of increased standoff, air blast barriers, stronger cladding and windows, and window coatings, such devices merely reduce but do not totally eliminate personnel injury, and, in many cases are difficult and/or expensive to install.

Accordingly, a need has arisen for a simple and effective apparatus that provides a "last line of defense" for the occupants of a building subjected to an explosion and prevents or significantly reduces injury to the occupants from flying debris from windows or the like. The window protection apparatus of the present invention fills this need and is not subject to any of the disadvantages of previously used systems.

SUMMARY OF THE INVENTION

In the apparatus of the present invention, a louver system is mounted adjacent to the inside and/or outside of a window and is constructed of strong, flexible slats which are normally in the open, generally horizontal position. Upon detection of an explosion or the like, the louvers are rapidly rotated to the closed, generally vertical position and are interlocked to either reduce the blast pressure on the window and cladding from the outside or to prevent propagation of window shards or debris into the room from the inside. Because of the interlocking of the slats, they are maintained in the closed position when the louver system is deflected inwardly by the bomb blast to protect the occupants from injury by flying debris from the window.

To reinforce the louver system during inward deflection by an explosion or the like, a plurality of generally vertically extending, high strength, high elongation cables or straps are mounted adjacent the interior surface of the louver system and are attached to the adjacent portions of the floor and ceiling to react to the resultant pressure loads on the louver system and translate these loads into in-plane floor or ceiling loads. The cables may be connected to a suitable shock absorbing system in the floor and/or ceiling to preclude failures associated with exceptionally high strain rate effects caused by the blast loads and to allow the cables to displace inwardly to reduce the out-of-plane floor or ceiling loads.

A pyrotechnically generated gas system may be used to rapidly rotate the louvers to the closed position before the window is subjected to the bomb blast. In operation, a sensor may be located remote from the window and is connected to the gas generating system to activate it upon the sensing of an explosion or the like.

BRIEF DESCRIPTION OF THE DRAWINGS

FIG. 1 is a side elevational view, partly in section, of the louver system of the present invention shown in an open position adjacent a window or the like;

FIG. 2 is a side elevational view similar to FIG. 1 wherein the louver system is closed and deflected inwardly by a bomb blast or the like;

FIG. 4 is an enlarged side elevational view of a portion of the louver system showing the louvers in a closed position before they are impacted by the blast from an explosion or the like;

DESCRIPTION OF THE PREFERRED EMOBIDMENTS

Figure 1:
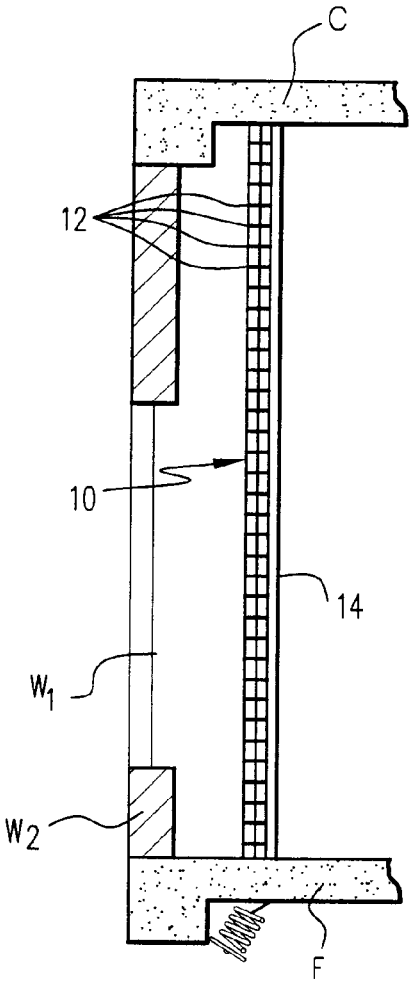

As shown in FIG. 1, the louver system 10 of the present invention comprises a plurality of substantially vertically spaced louvers 12 which are pivotally or otherwise movable and are shown in the open position wherein they extend generally horizontally. The louver system 10 is mounted adjacent to the inside or outside of a window $W_1$ and surrounding frame $W_2$. The louver system 10 may be mounted in any suitable manner on the adjacent portions of a ceiling C, floor F or other support structure disposed adjacent to window $W_1$. Preferably, the louvers 12 are pivotally movable from the open position shown in FIG. 1 to the closed position shown in FIGS. 2 and 4 wherein they are interlocked in a manner to be described more fully hereinafter. Any suitable structure may be used to support the louvers 12 and to move them from the open position to the closed position.

The louver system may be reinforced by a plurality of laterally spaced, vertically extending, high strength, high elongation cables or straps 14 which are positioned adjacent the interior surface of the louver system 10 and are anchored to the adjacent ceiling C or floor F as the case may be. The cables 14 serve to support the louver system 10 when it is deflected inwardly with the louvers 12 in a closed interlocked position in the event of a bomb blast or the like.

Figure 2:
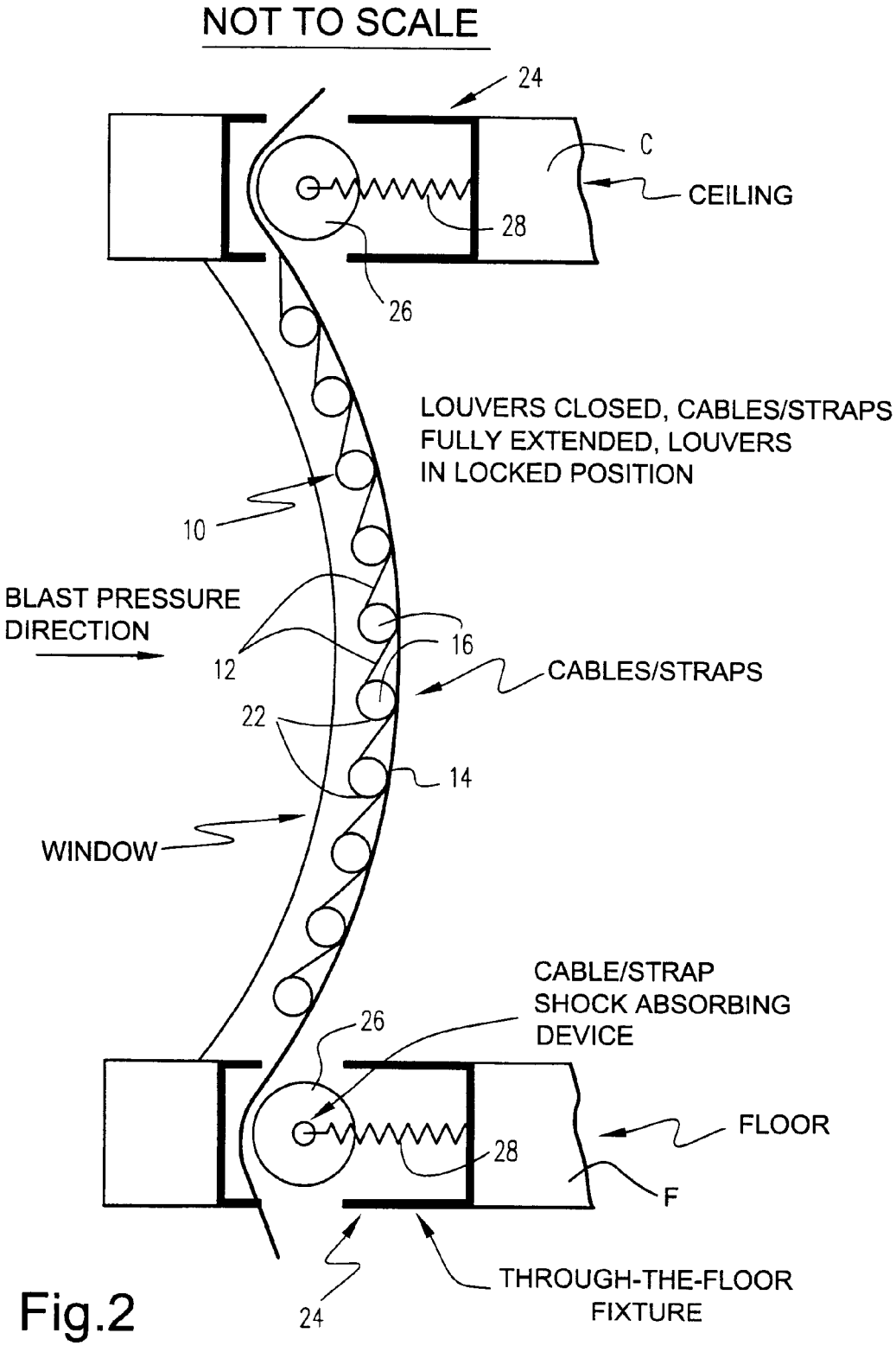
Figure 4:
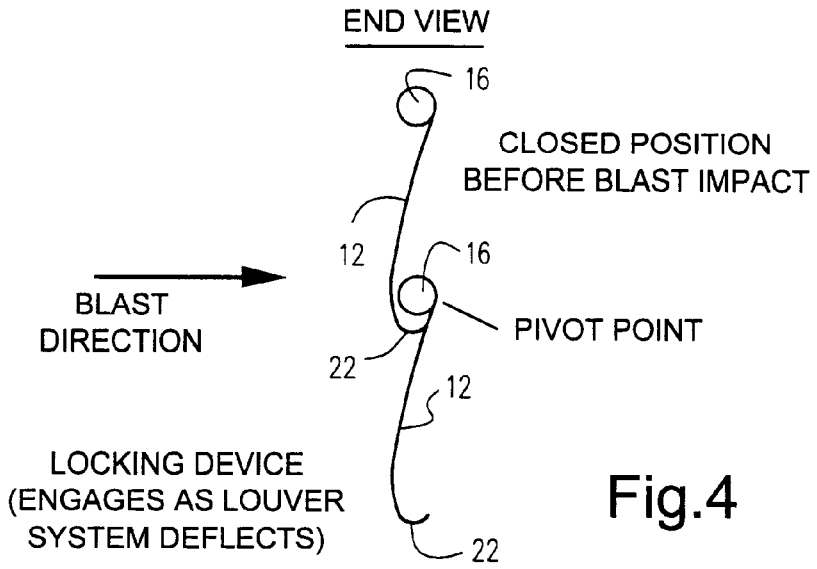

In one embodiment of the louver system shown in FIGS. 1–4, each louver 12 has a hinge pin 16 that is rotatably mounted at each end thereof on flexible support bars 18 having vertically spaced openings 20 therein in which the pivot pins are rotatably mounted. The support bars 18 are disposed on both sides of the window $W_1$ and are secured at their upper and lower ends in any suitable manner to the adjacent portion of the ceiling, floor or other support structure. The outer edge of each louver 12 is provided with a curved or hooked locking portion 22 which is positioned to be disposed adjacent the hinge pin portion of the louver disposed beneath it when the louvers are moved to the closed position as shown in FIGS. 2 and 4. In this manner, the louvers 12 are interlocked when the louver system 10 is deflected inwardly by a bomb blast or the like, as shown in FIG. 2, to provide a unitary shield from debris from the window and surrounding frame caused by an explosion or the like.

Figure 6:
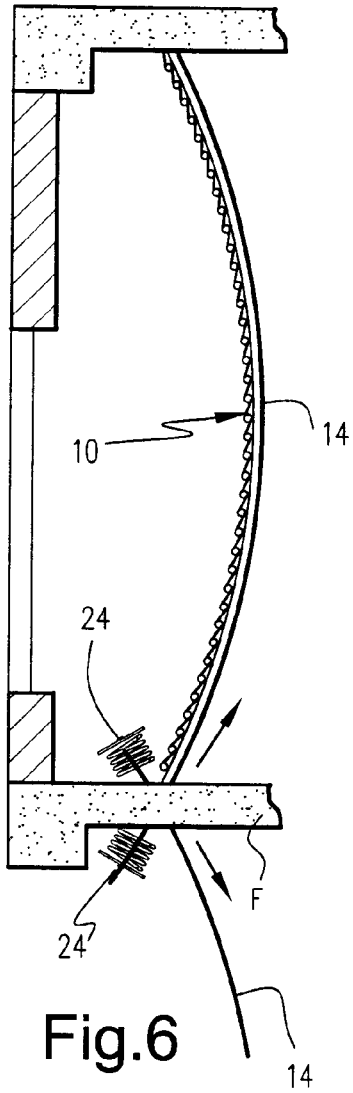
FIG. 6 is a side elevational view of a portion of the louver system showing a modified construction for anchoring the reinforcing cables to the floor.

As shown in FIG. 2, the reinforcing cables 14 will also be deflected inwardly by an explosion or the like and will support the closed louver system 10 and prevent its failure from the pressure caused by an explosion. The cables 14 may be fixedly secured at their ends to the adjacent portions of the ceiling C or floor F or, alternatively, may be supported by suitable shock absorbing devices 24 of any suitable construction mounted in the adjacent portions of the ceiling C or floor F. As shown in FIG. 2, the shock absorbing device 24 may be provided with a cable support member 26 and a shock absorbing spring 28 mounted in the adjacent ceiling or floor. As also shown in FIG. 2, the reinforcing cables 14 may extend through the floors and be supported by a shock absorbing device 24 in the adjacent portion of each floor so that the pressure loads from each exterior window in the event of an explosion will be relatively equal or balanced to produce a resultant in-plane load into each floor. In a further embodiment, the ends of the cables 14 could be anchored in shock absorbing devices located in each floor so that, in the event of a bomb blast, the loads on the floor are directed in substantially equal, opposite directions to minimize out-of-plane floor loads, as shown in FIG. 6.

Figure 5:
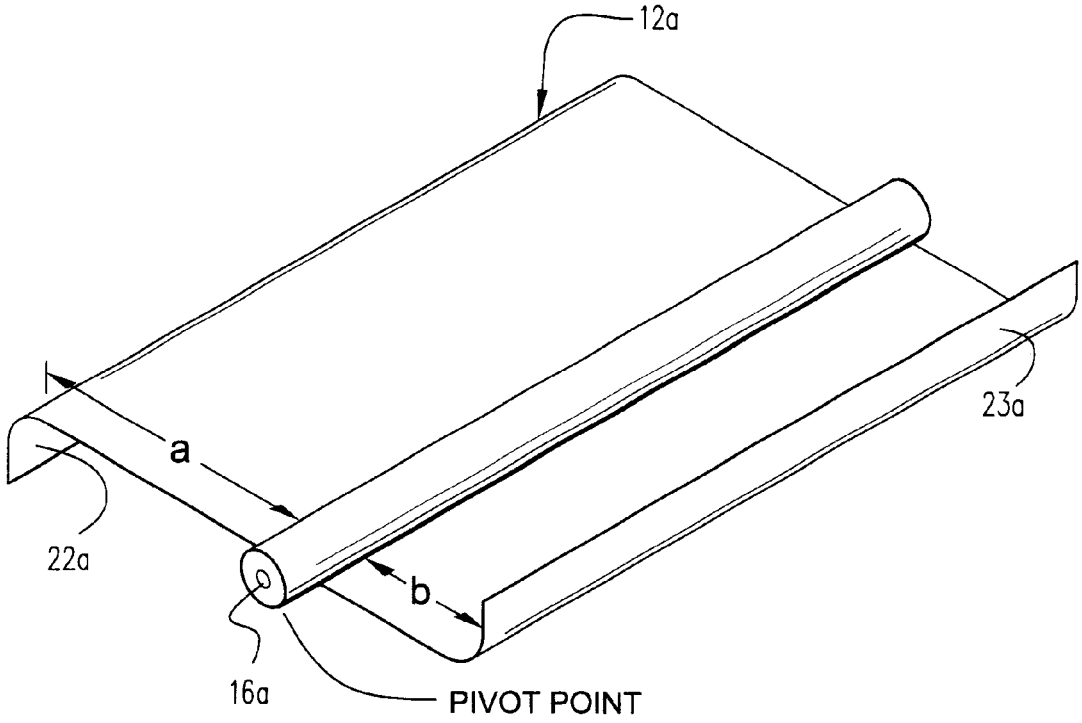
FIG. 5 is an enlarged perspective view of a modified louver construction.

FIG. 5 illustrates a modified form of louver 12*a* wherein the pivot pin 16*a* is disposed in a mid-portion thereof, and the end portions thereof are provided with oppositely extending hook or locking portions 22*a* and 23*a*. Upon the movement of the louvers to the closed position similar to that shown in FIG. 2, the locking portion 22*a* of each louver 12*a* will engage the locking portion 23*a* of the louver disposed beneath it so that the louvers will be interlocked in the closed position when they are deflected inwardly by an explosion or the like. The distance from the locking portion 22*a* to the pivot pin 16*a* is greater than the distance from the locking portion 23*a* to the pivot pin 16 so that the louvers 12*a* will be maintained in the closed position by the pressure from an explosion or the like.

The louvers 12, 12*a,* the reinforcing cables 14 and the support bars 18 may be formed of any suitable materials. As an illustrative example, the louvers 12, 12*a* may be formed of any suitable material; the reinforcing cables may be formed of nylon, kevlar, braided steel wire or the like; and the support bars may be formed of high strength advanced composite material or conventional high strength metals.

Figure 3:
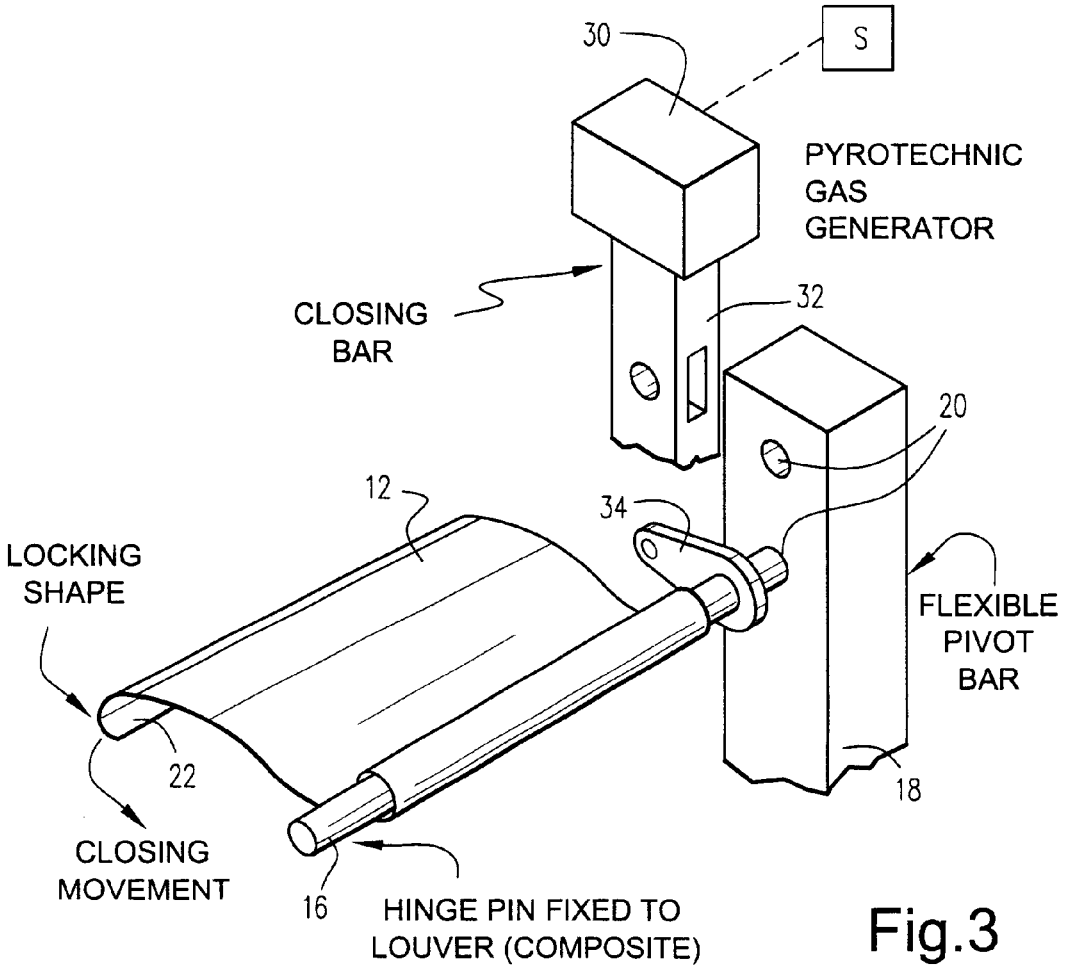
FIG. 3 is a perspective view of a portion of the louver system which shows the mounting and construction of the louvers and the device for closing the louvers.

Preferably, a sensor of any suitable type is located remote from the window $W_1$ to sense an explosion and activate a device of any suitable construction for moving the louvers from the open to the closed position before the window $W_1$ and surrounding frame $W_2$ are subjected to the blast from the explosion. As shown in FIG. 3, the sensor S may be operatively connected in any suitable manner to a louver closing device 30 such as a pyrotechnic gas generator or the like. The louver closing device 30 may be operatively connected in any suitable manner to the louvers 12 to move them to the closed position in the event of an explosion. As an illustrative example, the louver closing device 30 could be operatively connected to a movable rod 32 or the like that is connected to links 34 or the like secured to each hinge pin 16. In this manner, when the louver closing device receives a signal from the sensor S in the event of an explosion, it moves the rod 32 downwardly to pivot the links 34 downwardly to pivot the louvers 12 to the closed position shown in FIG. 4.

Figure 7:
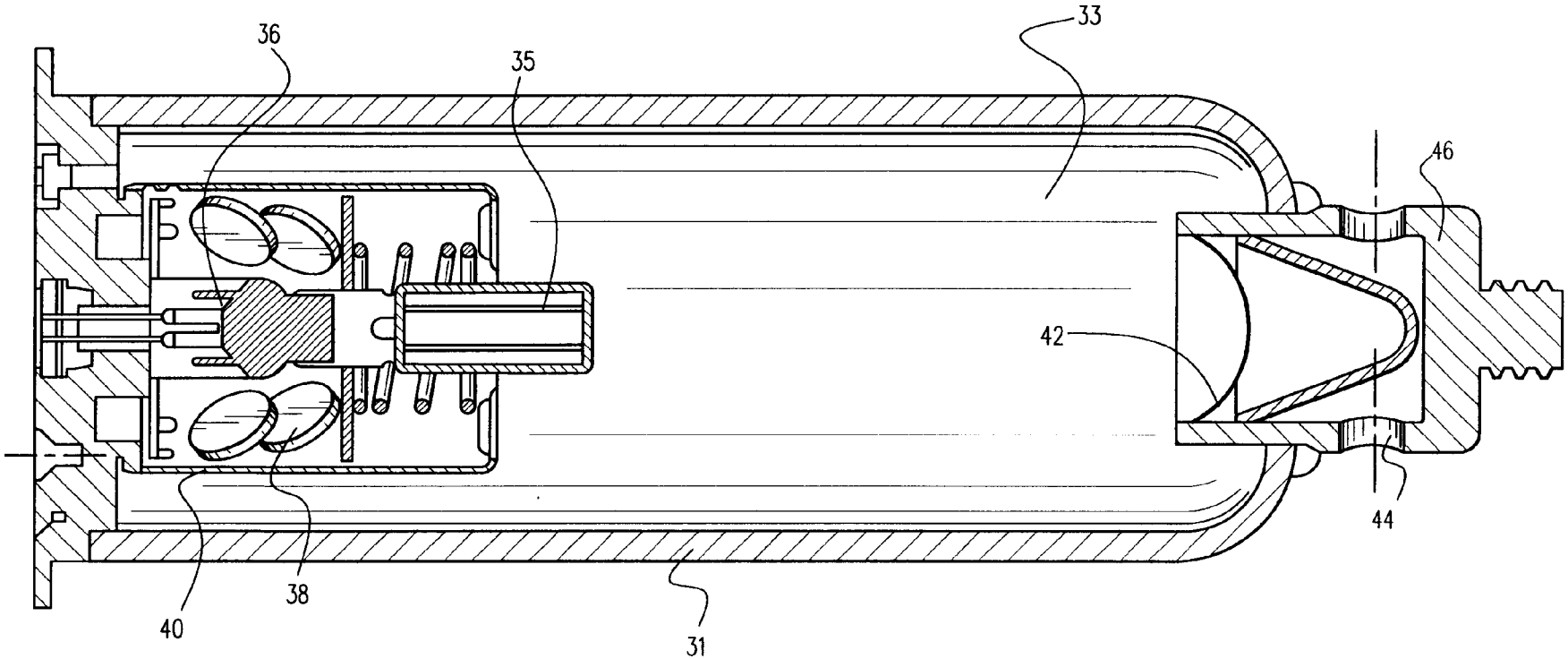
FIGS. 7 and 8 are side elevational views, partly in section, of different embodiments of gas generating devices that could be used to operate the louver system of the present invention.
Figure 8:
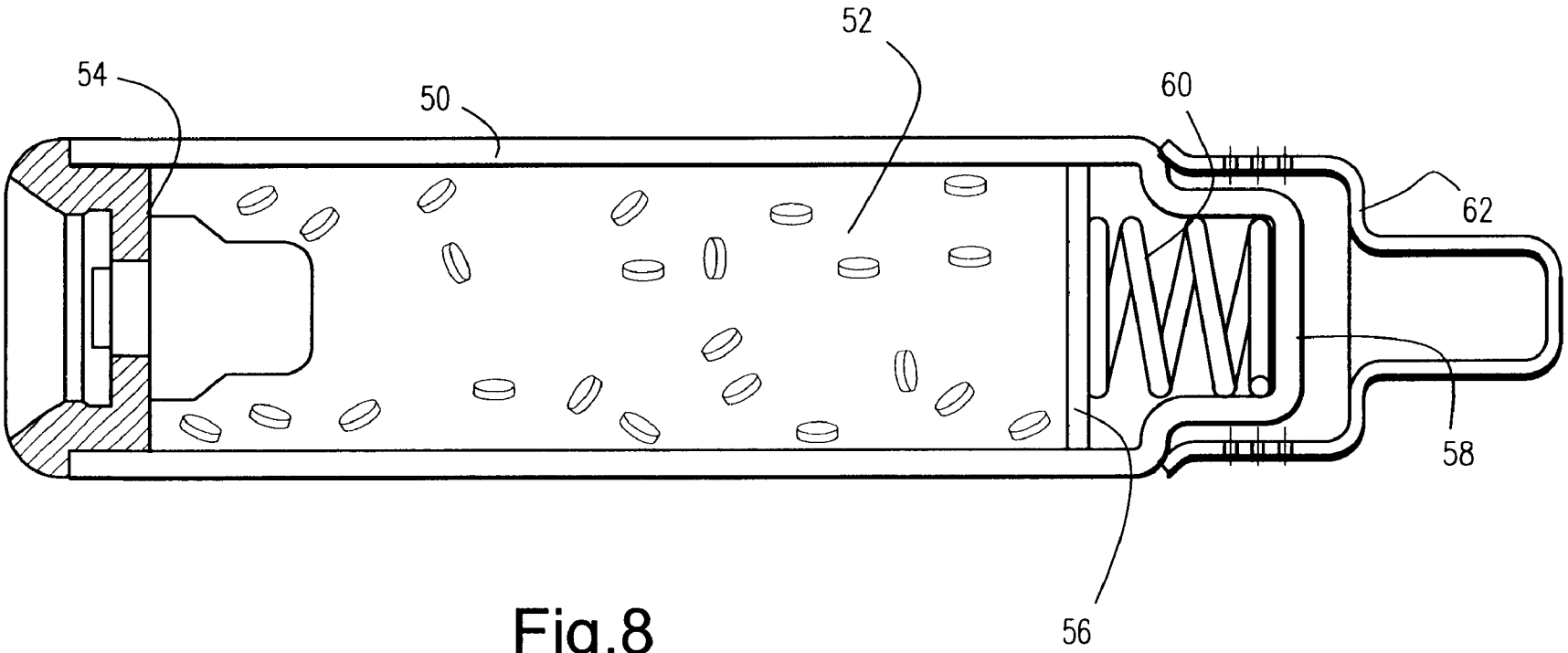

Examples of gas generating units that could be used as louver closing devices are shown in FIGS. 7 and 8. In the gas generating unit of FIG. 7, a pressure vessel 31 is used to store a gas mixture 33 under pressure. An ignition charge 35, i.e., a detonatable substance that detonates as a result of a signal, such as an electrical impulse from a sensor (not shown), is also present in the pressure vessel 31. Upon the detection of an explosion or the like, the sensor activates an igniter 36 which causes the ignition charge 35 to combust. This generates sufficient heat to cause a main generant charge 38 in a generant container 40 to burn and generate gases which pass through openings into the pressure vessel. The generated gas in combination with the stored inflation gas mixture 33 creates sufficient pressure to rupture a seal disc 42 and pass through outlet ports 44 in a manifold 46 positioned at one end of the pressure vessel. Thereafter, the expelled gases are directed to a movable device (not shown) such as a piston or the like operatively connected to the rod 32 to effect movement thereof.

FIG. 8 illustrates a modified gas generating unit wherein no gas is present until the igniter causes the propellant to break down and release the non-toxic particulate-free gases. Since no part of the unit is reserved for storage capacity, the device may be smaller than the gas generating unit of FIG. 7. A cartridge 50 holds a gas generant 52. At one end of the cartridge 50 is an initiator 54 that will combust to ignite the gas generant 52 in response to a signal from the sensor (not shown) which generates the signal as a result of an explosion or the like.

The end of the gas generating device opposite from that containing the initiator 54 holds a screen 56 upon which any particulates in the produced gas are retained, a burst disc 58, which is ruptured when the gas pressure exceeds a predetermined value, permitting the gas to escape from the cartridge 50, and a spring 60 to maintain a specific distance between the burst disc 58 and the screen 56. To ensure that the expelled gas is not released in an unduly strong stream, a diffuser 62 is affixed to the discharge end of the unit.

It will be readily seen, therefore, that the different embodiments of the occupant protection apparatus of the present invention provide simple and effective protection for the occupants of a building from flying debris from windows or the like in the event of an explosion outside the building. The protective barriers of the present invention have been shown in the drawings as being mounted on the inside of the window. In some cases, the protective barrier could be mounted on the outside of the window.

While the invention has been described in connection with what is presently considered to be the most practical preferred embodiments, it is to be understood that the invention is not be limited to the disclosed embodiments, but on the contrary, is intended to cover various modifications and equivalent arrangements included within the spirit and scope of the appended claims.

What is claimed is:

1. Apparatus in combination with a building for protecting an occupant of the building from flying debris from a frangible structure thereof, such as a window, in the event of an explosion or other blast, said apparatus comprising:

a protective louver system disposed adjacent said building structure, said louver system having an inner side and comprising a plurality of louvers that are movable from an open position to a closed position to form a protective barrier covering said building structure;

a louver closing device operatively connected to said louvers and being operable to move said louvers to said closed position in the event of an explosion or other blast, said louver closing device being a gas generating device comprising an ignitable gas generating composition that generates gas when ignited to move said louvers to said closed position;

said louvers having locking portions that engage each other when said louvers are closed and displaced inwardly by an explosion or other blast to lock said louvers together in the closed position to prevent them from separating and maintain the protective barrier to the explosion or blast.

2. The apparatus of claim 1, further comprising a sensing device located remote from the building and being operatively connected to said louver closing device, said sensing device being operable to effect the operation of said louver closing device in the event of an explosion or other blast.

3. The apparatus of claim 1, wherein said louvers are pivotally movable from said open position to said closed position, each louver having an inner end and an outer end, a hinge pin at the inner end thereof and a locking portion on the outer end thereof that is adapted to engage the inner end of the louver positioned underneath it when in the closed position and displaced inwardly by an explosion or other blast.

4. The apparatus of claim 1, wherein said louvers are pivotally movable from said open position to said closed position, each of said louvers having a hinge pin in the intermediate portion thereof, and oppositely extending locking portions on the inner and outer ends thereof.

5. The apparatus of claim 1, wherein said gas generating device is operatively connected to a movable rod, and said louvers are connected to said movable rod, whereby upon the occurrence of an explosion, said gas generating device effects movement of said movable rod in a direction to close said louvers.

6. The apparatus of claim 1, wherein each of said louvers has a hinge pin, generally vertically extending flexible support bars are disposed on both sides of said louvers and have vertically spaced openings therein, and said hinge pins are rotatably mounted in said openings of said support bars.

7. Apparatus in combination with a building for protecting an occupant of the building from flying debris from a frangible structure thereof, such as a window, in the event of an explosion or other blast, said apparatus comprising:

a protective louver system disposed adjacent said building structure, said louver system having an inner side and comprising a plurality of louvers that are movable from an open position to a closed position to form a protective barrier covering said building structure;

a louver closing device operatively connected to said louvers and being operable to move said louvers to said closed position in the event of an explosion or other blast;

said louvers having locking portions that engage each other when said louvers are closed and displaced inwardly by an explosion or other blast to lock said louvers together in the closed position to prevent them from separating and maintain the protective barrier to the explosion or blast; and a plurality of laterally spaced, substantially vertically extending high strength, high elongation cables disposed adjacent the inner side of said louver system to support said louvers in the closed position when they are displaced inwardly, said cables being anchored at their ends to the building.

8. The apparatus of claim 7, wherein the ends of said cables are operatively connected to shock absorbing devices in the adjacent portions of the building.

9. The apparatus of claim 7, wherein said building comprises multiple floors and said cables extend through said floors.

* * * * *